United States Patent [19]

Engelhard

[11] 4,055,333

[45] Oct. 25, 1977

[54] APPARATUS FOR HEAT TREATING WORK

[75] Inventor: William E. Engelhard, Owego, N.Y.

[73] Assignee: Owego Heat Treat, Inc., Apalachin, N.Y.

[21] Appl. No.: 682,491

[22] Filed: June 4, 1976

Related U.S. Application Data

[60] Division of Ser. No. 592,040, June 30, 1975, Pat. No. 3,972,751, which is a continuation-in-part of Ser. No. 380,067, July 17, 1973, abandoned.

[51] Int. Cl.[2] ..... C21D 1/62

[52] U.S. Cl. ..... 266/130; 266/131; 134/105; 134/154

[58] Field of Search ..... 148/149, 153; 134/105, 134/114, 154, 182, 183; 266/114, 120, 130, 131, 132, 133, 256, 275, 276

[56] References Cited

U.S. PATENT DOCUMENTS

| | | | |
|---|---|---|---|
| 2,374,535 | 4/1945 | Gibson | 134/165 X |
| 2,862,843 | 12/1958 | Engelhard | 266/130 X |
| 2,975,083 | 3/1961 | Engelhard | 266/132 X |
| 3,229,967 | 1/1966 | Engelhard | 266/905 X |
| 3,415,694 | 12/1968 | Engelhard | 148/153 X |

FOREIGN PATENT DOCUMENTS

| | | | |
|---|---|---|---|
| 449,705 | 7/1936 | United Kingdom | 266/132 |

*Primary Examiner*—Roy Lake
*Assistant Examiner*—Paul A. Bell

[57] ABSTRACT

A novel apparatus for automatically heat treating ferrous work rapidly from austenite stage temperature through the martensite state and automatically slowly cooling the same thereafter to impart uniform hardness and other desired characteristics thereto, eliminating risk of warpage, cracking, distortion and variations therein. The invention includes a work holder within which the work is positioned during the automatic heat treating procedures, the work holder being provided with an upstanding vertical perforated wall such that, on positioning the work holder and work, after being preheated in a furnace, into the quenching medium, the work will be automatically quenched and cooled through the rapidly cooling initial and subsequent slow cooling time and temperature stages, achieving uniform transformation and hardness of work having varying forms and thicknesses to the martensitic transformation stage.

19 Claims, 17 Drawing Figures

APPARATUS FOR HEAT TREATING WORK

This application is a divisional application, of application Ser. No. 592,040, filed June 30, 1975 now U.S. Pat. No. 3,972,751, which is a continuation in part of application Ser. No. 380,067 filed July 17, 1973 and now abandoned.

OBJECTS OF THE INVENTION

A prime object of this invention is the provision of a novel heat treating procedure substantially reducing and eliminating the A' and A sections of the "S" curve such as shown at pages 16, 17, Vol. 2, (1964) ASM "Metals Handbook" 8th Edition (below referred to as 1964 ASM handbook) thus exposing the steel to be hardened essentially directly to the B. section, where the maximum rate of heat transfer occurs.

Another object of the invention is to move the B section upwardly so that it is effective in the 1300° to 1200° F. area; it being essential to assure full hardening that the cooling rate clear the "nose" of the "S" curve, which is generally in this temperature range.

A further object is to provide a much slower cooling rate after the "S" curve "nose" is passed so that temperatures may equalize between outside and center and between heavy and light sections before the work reaches the MS point (page 37 of 1964 ASM handbook).

Further objects are:

To obtain the maximum rapid initial cooling rate required to insure full hardening of steel parts when cooled from their austenizing temperature, To arrest this cooling rate immediately and automatically after the lower limit of the rapid cooling range has been reached, To accomplish these objects in one quench rather than, as heretofore in this art, to have to resort to step-quenching or to use a specially heated bath, To eliminate the need for providing extraneous mechanical or other anti-warping procedures or apparatus, and to achieve the same automatically, To automatically achieve the objectives above recited and others and to enhance the accuracy and efficiency of the procedures as described herein.

DESCRIPTION OF THE DRAWINGS

Embodiments of the invention are illustrated, by way of example, in the appended drawings, wherein similar reference characters indicate like parts, and wherein.

DESCRIPTION OF PREFERRED EMBODIMENTS

Pursuant to my invention, a work holder is provided having an apertured vertical baffle wall such that, on the work holder coming into contact with the quenching medium, the apertured baffle barrier wall will baffle and slow down flow of the quenching medium into the work holder until the quenching media has had intimate contact and rapid heat transfer interchange with the baffle wall. All of the work will thus be uniformly rapidly cooled, transferring energy at the highest rate, as the quenching medium is at or near its boiling point (350°-700° F.).

On initially lowering the work holder into the quenching medium, pursuant to this invention (FIGS. 1, 2) intense heat interchange occurs between the (previously heated) work holder and work and the (previously at room or slightly higher temperature) quenching medium, generating vapors 48 (FIG. 2) which rise and are entrapped in the heat shield, moving the heat shield upwardly until (FIG. 2) the shield contacts a stop member in the apparatus which will prevent movement of the lower edge of the shield above the top of the work holder wall. Stage B, the vapor transport cooling stage, which produces the highest rate of heat transfer, then occurs, the temperature of the surface metal being then reduced somewhat, the continuous vapor film collapses. Violent agitation and boiling of the quenching liquid occurs and heat is removed from the metal at a very rapid rate, largely as heat of vaporization. The vapors so entrapped in the field are thereupon valved out of the shield or otherwise released by the operator or by automatic sensing means. The operation just described is practically instantaneous — a second or less in point of time. A hoist to which the supporting cable 30 for the work holder support pipe is actuated or manipulated to lower the work holder while the heat shield is descending so that the work holder will normally never be below the bottom of the shield.

Figure 4:
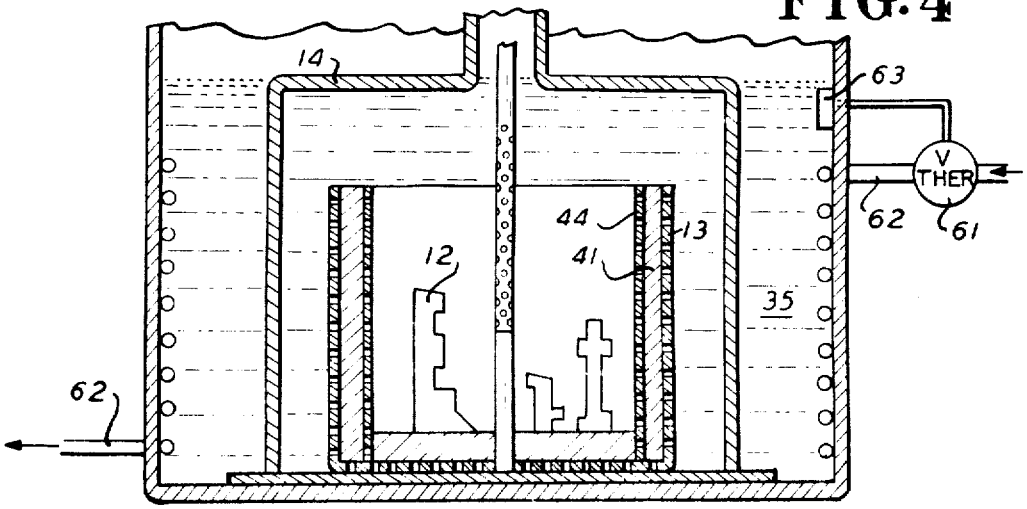
FIG. 4 is a similar view, showing the protective shield lowered over the work holder and isolating and sealing the work holder, work and quenching medium therein from the quenching medium in the tank therearound.

Thus, pursuant to the invention, automatic initial high speed, uniform and practically instantaneous initial phase cooling of the preheated work and work holder is achieved as the quenching medium flows inwardly through the baffle barrier wall and onto all parts of the work simultaneously, for uniform rapid heat exchange therewith. The boiling which thus occurs within the work holder or container 13 pursuant to the invention serves as a stirred liquid bath, automatically bringing thin and thick sections of the work to exactly the same temperature at precisely the period when the need for such uniformity, preventing cracking or warping is greatest. Then the heat shield descends to overlie the work holder, isolating the latter and work therein in that portion of the volume of quenching medium in the quenching tank entrapped interiorly of the heat shield and work holder and work therein (FIG. 4). The automatic slow and uniform cooling occurs with the work and work holder so shielded by the heat shield from the quenching medium intermediate the shield and the quenching tank wall. At the conclusion of the cooling operation (when the parts will have slowly cooled to the temperature of about 325° F. in their final cooling phase, FIG. 4 as above described) the work holder 13 and shield 14 may be elevated out of the quenching tank 21 and the quenching oil 28 allowed to drain back into the quenching tank 21. Cooling of the parts and apparatus to room temperature proceeds by heat interchange with ambient and still air.

Figure 15:
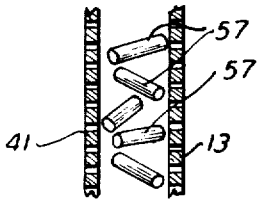
FIG. 15 is a fragmentary view, similar to FIG. 8, but showing quenching medium baffle parts formed of short sections of rods or wire.
Figure 16:
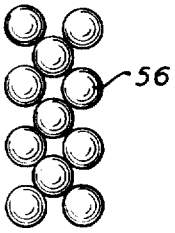
FIG. 16 is a vertical sectional view showing cylindrical baffle members vertically arranged to form a quenchant baffle barrier wall.

As above noted, at the initiation of the heat treating procedures of this invention, the work holder 13 (FIG. 1 of the drawings) first floats on and slightly in the quenching medium 28, opening the way for the quenchant 28 to reach the work holder wall 13 and barrier wall 41 which, with the work 12 therein, has been preheated by a suitable heat source, such as a furnace, to austenizing temperature - for example from 1400° to 2200° F. The quenching medium, normally of room temperature, will become boiling in the range "B" (page 16, 1964 ASM handbook) Stage B, the vapor transport cooling stage. The work holder 13 and quenching tank 21 preferably are cylindrical in form and of a material satisfactory for exposure to heat treating temperature, holding their shape without deteriorating or scaling, and made of a material such as nickel-chrome alloys; "Inconel 600" is a typical example and "Nichrome" alloy 33 another. The work holder 13, heat shield 14 and quenching medium tank 21 thus are preferably circular in cross section and dimensioned to suit the tasks to be thus performed. For larger work, such as naval gun barrels and landing gear for aircraft, for example, the dimensions of the apparatus would correspondingly be substantially greater. The pellets forming barrier wall 41 between the outer and inner walls of the work holder (FIGS. 8–11) may be spherical or of other contours, such as short rods or wire lengths or other pellet forms (FIG. 15). Spheres 56 (FIGS. 8–11) are preferred for barrier wall 41, since they eliminate through flow openings and provide a maximum weight per surface and contact surface area and being spherical provide a smooth flow surface for the quenchant to engage therewith and flow therearound. Excellent results have been obtained in use of cylindrical high speed steel pellets for example 3/16 and ¼ inch in diameter have been formed satisfactory in carrying out the invention for the reasons above mentioned and additionally as they may be readily "poured" into the space between the work holder walls, and onto the bottom wall of the work holder, where desired, and readily "poured" out when desired, being readily individually movable, facilitating all of the described procedures. However, the pellets may be of copper, "Nichrome" or any other metal with a melting point above that of the working range of the work being heat treated, and said pellets may be positioned in welded vertically arranged form (FIG. 16) to then constitute the vertical wall of the work holder or they may be fixed, as by welding or otherwise, to rods 58 to form said vertical wall.

Figure 17:
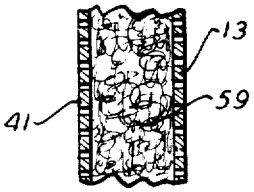
FIG. 17 is a view similar to FIG. 8 but showing mesh material as the quenching barrier means positioned adjacent the work holder wall.

A foramimous sheet or material of steel wool or the like such as shown at 59 (FIG. 17) may be positioned between the walls of the work holder or secured to wall 13 thereof to constitute the barrier 41. Fine wire steel or other mesh, for example, approximately 0.0003 inch diameter, may be compressed to sheet or other form, to form baffle 59 (FIG. 17).

Figure 13:
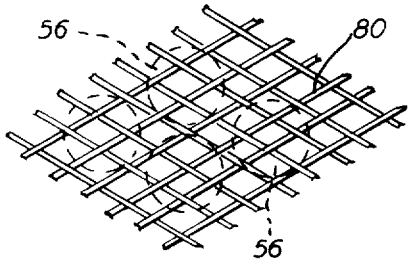
FIG. 13 is a fragmentary perspective view of a form of work holder formed of wire or other mesh material.
Figure 14:
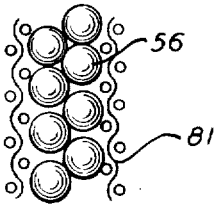
FIG. 14 is a partly fragmentary, vertical sectional view of a work holder formed of mesh.

Instead of the apertured work holder wall 13 a grid 80 (FIG. 13) may be used or (FIG. 14) wire, screen or mesh wall 81 may be used for the walls of the work holder.

Figure 1:
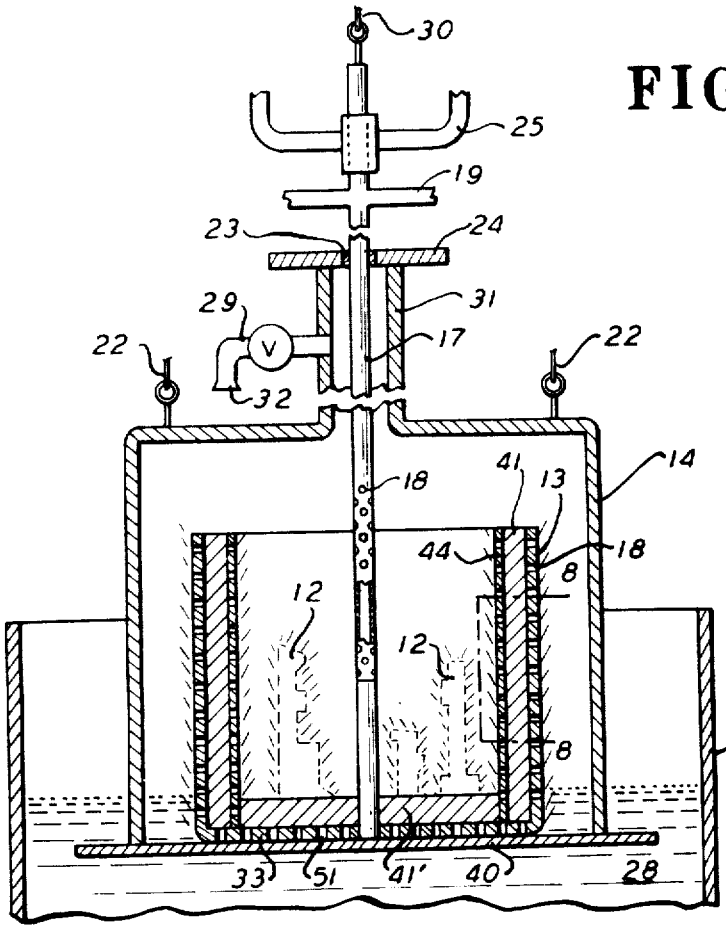
FIG. 1 is a vertical, partly broken, sectional view of an apparatus for carrying out the invention, shown in initial position, with the apparatus buoyant on and slightly penetrating the top of the quenching medium, extending slightly thereinto and floating thereon, sealing the work and work holder from ambient air.

The apertured outer work holder wall 13 is satisfactory for some heat treating procedures pursuant to this invention but, where maximum possible uniformity and quality are desired, the heat exchange pellets 56 are used and, in the form shown in FIG. 1, are positioned between outer wall 13 and inner wall 44 of the work holder, thus forming the baffle barrier wall 41. Additionally, the pellets may (FIG. 1) be positioned on the bottom of the work holder to form a bottom barrier wall 41' on the apertured bottom wall 33 of the work holder. The barrier wall 41 (FIG. 1) may be suitably positioned on or secured to the vertical wall 13 of the work holder, which in turn, is apertured, as at 18, for flow of the quenchant medium therethrough and in heat interchange therewith and thence interiorly of the work holder and onto the work as above described. A second, similarly apertured inner work holder wall 44 (FIG. 1) may be positioned in spaced relation to the wall 13, with the barrier means 41 positioned intermediate the walls (FIGS. 1, 8–11) for flow thereon and therethrough of the quenching medium.

The work holder 13 may be formed as a cup shaped cylinder 13 and may be slipped over the support pipe 17 to rest on the work holder supporting plate 40 or otherwise formed as desired.

Figure 10:
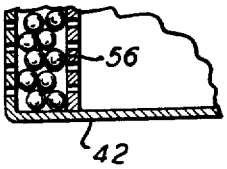
Figure 11:
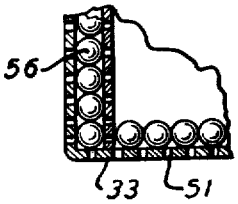
Figure 12:
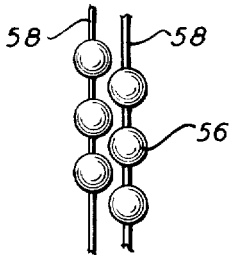
FIG. 12 is a fragmentary vertical elevational view of a form of the invention wherein the work holder wall is formed of rods to which the barrier members are secured.

The bottom wall 33 of the work holder may as above noted, be provided with apertures 51 and with baffle barrier means 41' thereon, the quenching medium flowing through from the bottom into the interior of the work holder (FIGS. 1–3, 9) or it may be formed solid as at 42 (FIG. 10).

Figure 5:
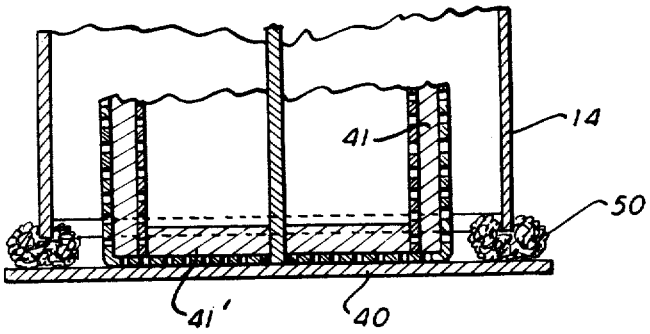
FIG. 5 is a fragmentary lower end view of the parts similarly positioned, showing a gasket (shown enlarged for clarity) on the work holder bottom plate for engagement of the lower edge of the heat shield therewith.

After temperatures in the work holder 13 in the final (FIGS. 4, 5) positions of the apparatus cool to below the flash point of the quenching medium 28, the assembly can be lifted clear, the oil allowed to drain back into the quenching tank and permitted to cool to room temperature in still air.

As shown in the drawings (FIG. 1) the invention comprises a process and apparatus for heat treating work 12, such as iron and iron-alloys work which has been preheated in a furnace to elevate it to a desired predetermined temperature prior to heat treatment, for example, to a temperature of typically approximately 1,800° F. As an example of a use of the invention and without limitation thereto, it is noted that work may typically be tools or any other parts wherein precision hardening and heat treatment thereof is desirable, preheated in the range of temperature to such work from about 1400° to about 2250° F, for high speed steels.

The thus preheated work holder and parts therein are transferred from the furnance to the quenching medium tank 21 while being preferably flushed with a neutral gas, for example (FIG. 1), gas pumped through source pipe 19 and thence through the upper hollow section of work holder support pipe 17 apertures 18 therein for discharge of the gas therethrough. The neutral gas such as dissociated ammonia, argon, helium or other suitable gas, is thus pumped through line 19, under barely atmospheric pressure — 10 or 15 pounds out of the line being adequate. No substantial pressure is necessary as the gas flows through the work holder 13 and onto the work and then (FIG. 5) escapes through a stainless steel wool gasket 50 secured to a bottom support plate 40 which may be secured as at (FIG. 1) by welding or otherwise to the lower end 15 of the work holder support pipe 17 or otherwise connected thereto or to the work holder 13. When the gasket 50 is so engaged by the lower edge of the heat shield 14 the gasket is compressed. A steel wool gasket when so engaged prevents flow of the quenching medium therethrough while allowing escape of the gases therethrough. The gasket may be made of any other material functioning similarly. Thus the gasket guards against escape of gas out of one side of the apparatus and air infiltration at the other side. Gas pressure is preferably maintained from the time the heat shield and work holder and work are lifted out of the furnace, brought over and into (FIG. 1) the quenching tank to the time the heat shield and work holder touch the quenching medium. The atmospheric gas may then be shut off manually by the operator or automatically.

At the initial (FIG. 1) position of the parts the heat shield 14 rests on the wool gasket 50; flames emit from the apparatus therethrough.

As the work holder and work goes down (FIG. 2) into the quenching medium there is an immediate and intense generation of vapors and fumes 48 upwardly into the heat shield 14 which thus becomes buoyant and rises slightly. The weight of the shield is calculated empirically to achieve the desired buoyancy and facility of movement of the heat shield.

THE QUENCHING MEDIUM

As above noted, in the method of this invention, initially only the trapped portion of the oil quenchant 28 interiorly of the work holder touches the steel work 12. As the process of this invention (FIG. 4) moves toward completion the outer quenchant, that is, the balance 35 of the quenchant between the wall 13 of the work holder and the wall of the quenching tank 21 serves as a source to fill the work holder 13, and next (FIG. 4) as a seal to prevent air from reaching the super-heated oil inside the work holder 13, and, finally (FIG. 4) as a coolant through the walls of the work holder until temperatures inside are below the flash point. Then the work holder may be safely lifted out of the quenching tank 21.

The temperature of the quenching medium used in carrying out this invention need only be at or about quenching room temperature — typically from 70° to 120° F. A conventional quenching oil such as *Gulf Super Quench* 70 of which the following is a typical properties chart may be used the quenchant in carrying out the invention:

"TYPICAL PROPERTIES" CHART OF GULF SUPER-QUENCH 70
by Gulf Oil Co. of Houston, Texas
SP 13346 DM 6/72

| | |
|---|---|
| Gravity: ° API | 30.8 |
| Viscosity, SUV: Sec. | |
| 70 F. | 185.0 |
| 100 | 94.6 |
| 122 | 68.5 |
| 130 | 62.5 |
| 210 | 39.2 |
| Viscosity Index | 112 |
| Flash, OC: F | 375 |
| Fire, OC: F | 435 |
| Pour: F | −5 |
| Color, ASTM D 1500 | D8 |
| Carbon Residue, Ramsbottom: % | 0.68 |
| Neutralization No. | |
| ASTM D 974 | |
| Total Acid No. | 0.04 |

FURTHER DESCRIPTION OF PREFERRED EMBODIMENTS

Figure 2:
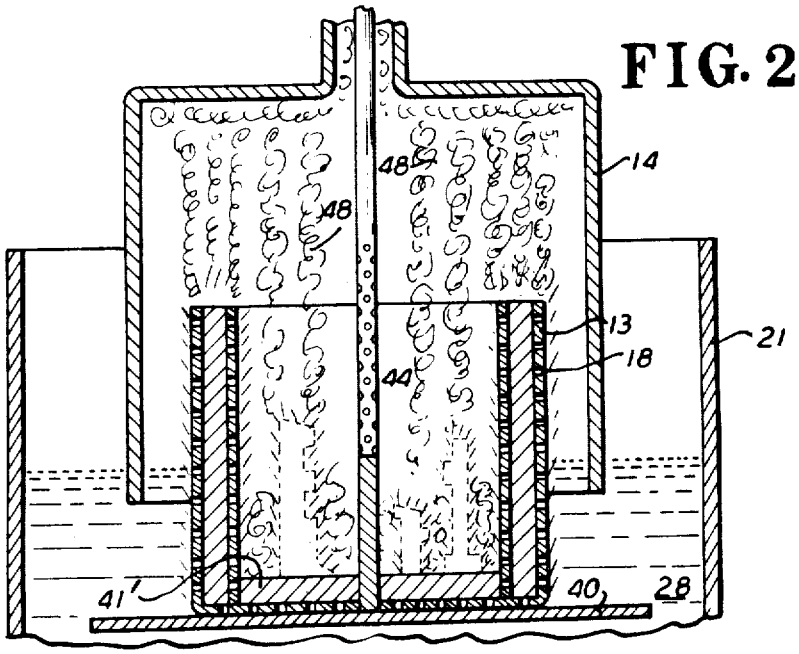
FIG. 2 is a fragmentary, similar view thereof, showing the work holder lowered farther into the quenching medium.
Figure 3:
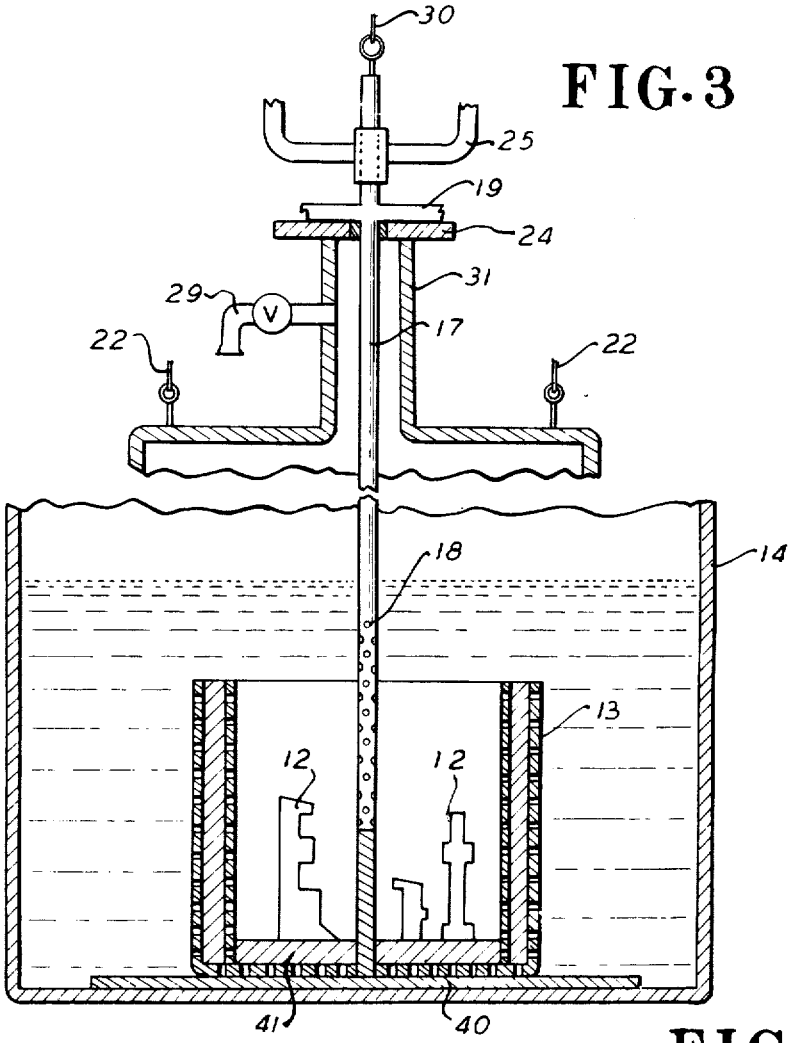
FIG. 3 is a similar view, showing the work holder lowered to the bottom of the quenching tank.
Figure 6:
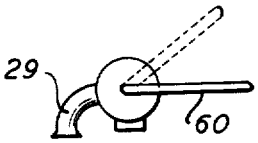
FIG. 6 is a side elevational view of a form of vapor and gas venting valve which may be used in carrying out the invention, showing, in full and dotted lines, open and closed positions thereof.
Figure 7:
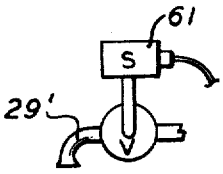
FIG. 7 is an exemplary similar view of an automatic valve means which may be used in carrying out the invention.
Figure 8:
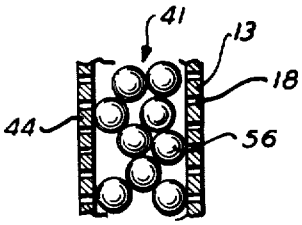
FIG. 8 is an enlarged fragmentary, vertical, sectional view taken at line 8—8 of FIG. 1.
Figure 9:
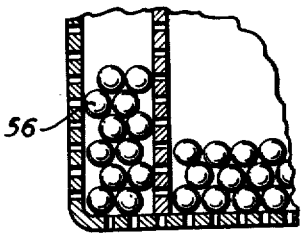
FIG. 9 is an enlarged, partly fragmentary view of the lower left-hand corner of the work holder shown in FIG. 1, FIGS. 10 and 11 are enlarged partly fragmentary views of further forms of such lower corners of work holders of the invention.

In the FIG. 2 position of the parts, as soon (as above described) as the heat shield 14 rises, responsive to the vapors 48 generated, up to the point (previously calculated) wherein a part, such as the upper end, or plate 24 of the heat shield, which may be formed unitarily with or secured to the neck portion 31 of the heat shield 14, contacts (FIG. 3) a part, such as gas pipe 19 or other stop part on rod 17 of the apparatus, further upward movement of shield 14 is thus halted. The shield 14 may have a gasket 23 which may be calculated to prevent escape of the gases flowing into the shield to hold the latter in the FIG. 1 position buoyant on and slightly into the quenchant until the intense vapor generation phase (FIG. 2). The operator, on noting the (FIG. 3) contact of shield 14 with stop 19, opens the valve 29 (by means such as 60, FIG. 6) so that the fumes and vapors 48 that were previously urging the heat shield 14 upwardly are allowed to escape. An automatic sensing valve 29 may be provided (FIG. 7) such that on stop contact of the parts 24, 19 (FIG. 3) solenoid or other means 61 will open the valve automatically. When the vapors escape more rapidly than they are being generated the shield drops down onto the work holder support plate 40 to envelope the work holder. Boiling of the quenchant which occurs within the work holder or container 13 in this stage of the invention, serves to bring thin and thick sections of work to exactly the same temperature uniformly timewise and at precisely the period when the need for such uniformity is greatest to prevent cracking or warping. This contact between the work 12 at 1800° F. and the quenchant occurs with the quenchant at a temperature at or near the 650° F. or its maximum boiling point, transferring energy at the highest rate. Then the work cools rapidly until the temperature of oil reaches the lowest temperature of boiling point of the fraction of blend of the quenchant involved. Thus, at the conclusion of the vapor phase cooling operation (when the parts will have rapidly cooled but at a progressively slower rate as the quenching medium approaches the boiling point of the lowest fraction thereof— to the temperature of about 325° F., as above described) the slow cooling phase then begins, with very slow conduction and/or convention cooling, between 325° and 70° F. Or the work holder 13 and shield 14 may be elevated out of the quenching tank 21 and permitted to further cool in air.

In prior practices, wherein the work was exposed to direct contact with the entire quenching medium, the temperature of the quenching medium varied from point to point— itmight, for example, be 140° F. at one point and 500° to 600° F. at another point, resulting in objectionable warping and other effects above noted.

In the apparatus of this invention, the necessity for preheating the quenching medium is eliminated and the entire quenching procedures are carried out with the work sealed from the atmosphere. If it were desired, the quenching medium could be automatically maintained at a predetermined temperature by providing sensing means such as a thermocouple 63 in tank 21 (FIG. 4) controlling cooling or heating means 62 coiled interiorly of tank 21 through pipes controlled by a solenoid or other valve 61.

While this invention has been particularly set forth in terms of specific embodiments thereof, it will be understood in view of the present disclosure that numerous variations upon the invention are now enabled to those skilled in the art, which variations nevertheless are within the scope of the present teaching. Accordingly the invention is to be broadly construed and limited only by the scope and spirit of the claims appended hereto.

I claim:

1. In an apparatus for cooling work which has been preheated and positioned in a work holder;

quenching medium means proportioned to freely receive said work holder therein, means for positioning said work holder in said quenching medium means, said work holder including a wall apertured for flow of said quenching medium therethrough and onto the work in said work holder, to cool said work, a plurality of heat exchange units, and means so positioning said units on said wall, whereby, on positioning said work holder and work in said quenching medium, said medium will flow through said apertured wall of said work holder and onto and around said heat exchange units and into the work holder and onto said work, and cooling the same.

2. In an apparatus for heat treating work as set forth in claim 1, said means so positioning said units comprising a second wall on said work holder spaced from said work holder first mentioned wall, said heat exchange units being positioned between said walls.

3. In an apparatus for heat treating work as set forth in claim 1, said means so positioning said heat exchange units along said wall in vertical alignment therewith.

4. In an apparatus for heat treating work as set forth in claim 1, said heat exchange units being spherical.

5. In an apparatus for heat treating work as set forth in claim 1, said heat exchange units being steel spheres approximately ¼ inch in diameter.

6. In an apparatus for heat treating work as set forth in claim 1, said heat exchange units being pellets ¼ to 3/16 of an inch in diameter.

7. In an apparatus for heat treating work as set forth in claim 1, said heat exchange units being steel pellets ¼ to 3/16 of an inch in diameter.

8. In an apparatus for heat treating work as set forth in claim 1, said heat exchange units being steel pellets.

9. In an apparatus for heat treating work as set forth in claim 1, a bottom wall to which said apertured wall of the work holder is connected and from which it extends upwardly.

10. In an apparatus for heating treating work as set forth in claim 1, said work holder having an apertured bottom wall and a plurality of pellets positioned on said bottom wall.

11. In an apparatus for heat treating as set forth in claim 1.

said means so positioning said units on said wall comprising a second wall in said work holder having apertures therein disposed in spaced relation to the first mentioned wall, whereby said quenching medium will flow through said apertured walls and onto said work.

12. In an apparatus for cooling work which has been preheated and positioned in a work holder, as set forth in claim 1, a second work holder wall forming with said first mentioned wall a pair of wall members disposed in spaced relation, each wall member having apertures therein.

13. In an apparatus for cooling work as set forth in claim 1, said work holder wall comprising a pair of wall members disposed in spaced relation, said heat exchange units positioned intermediate said walls, whereby said quenching medium will so flow through said walls and onto and around said heat exchange units and into the work holder and onto said work and will cool the same.

14. In an apparatus as set forth in claim 13 said heat exchange means comprising a plurality of pellets so movably positioned intermediate said wall so of said work holder so that the quenching medium will so flow into contact therewith and with said pellets and into the work holder and onto the work, to so rapidly cool the work.

15. In an apparatus for automatically cooling ferrous work in a work holder of generally upwardly opening form to receive said work therein, to harden the same uniformly, said work having been preheated to impart uniform characteristics to said work; said apparatus comprising:

a. a work holder of generally upwardly opening form to receive said work therein, and comprising a pair of spaced apertured wall members and a bottom wall connected to said wall members and on which the parts may be positioned, b. said vertical wall members being provided with apertures for contact with and flow therethrough of quenching medium for quenching said work in said holder, c. a quenching tank of larger dimensions then said work holder for receiving said fluid quenching medium and work holder therein, d. and means in said apparatus for positioning the work and work holder receiving the same in alignment with said fluid quenching medium tank, e. whereby the work holder with the work therein may be moved into said quenching medium, so that the quenching medium will flow through the vertically apertured walls into the holder and onto said work therein, for heat interchange therewith, thereby cooling the work.

16. In an apparatus as set forth in claim 15:

a plurality of spherical pellets positioned on the bottom of said work holder.

17. In an apparatus as set forth in claim 15, a plurality of pellets positioned intermediate said vertical wall members.

18. In an apparatus as set forth in claim 15, steel pellets positioned intermediate said apertured vertical walls.

19. In an apparatus as set forth in claim 15, a plurality of cylindrical pellets positioned intermediate said vertical walls of said work holder.

* * * * *